US006272422B2

(12) United States Patent
Khalid et al.

(10) Patent No.: US 6,272,422 B2
(45) Date of Patent: Aug. 7, 2001

(54) METHOD AND APPARATUS FOR USE IN CONTROL OF CLEARANCES IN A GAS TURBINE ENGINE

(75) Inventors: Syed J. Khalid, Palm Beach Gardens; Craig W. Irwin, Jupiter, both of FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/753,594

(22) Filed: Jan. 4, 2001

Related U.S. Application Data

(63) Continuation of application No. 09/220,546, filed on Dec. 23, 1998, now abandoned.

(51) Int. Cl.[7] ..... F02C 9/00
(52) U.S. Cl. ..... 701/100; 701/29
(58) Field of Search ..... 701/29, 100; 415/1, 415/17

(56) References Cited

U.S. PATENT DOCUMENTS 4,513,567 * 4/1985 Deveau et al. ..... 60/39.02
4,849,895 * 7/1989 Kervistin ..... 701/100
4,971,517 * 11/1990 Perkey et al. ..... 415/14
4,999,991 * 3/1991 Haddad et al. ..... 60/39.02
5,005,352 * 4/1991 Schwarz et al. ..... 60/39.02
5,012,420 * 4/1991 Walker et al. ..... 701/100
5,088,885 * 2/1992 Schwarz et al. ..... 415/115

OTHER PUBLICATIONS

Evans, C.; Testing and modelling aircraft gas turbines: an introduction and overview; Control '98.*
UKACC International Conference (Conf. Publ. No. 455); vol. 2, pp. 1361–1366; Sep. 1–4, 1998.*
Korson, S. et al.; An H/sub /spl infin// based controller for a gas turbine clearance control system.*
4th IEEE Conf. on Control Applications, 1995; Sep. 28–29, 1995; pp. 1154–1159.*

* cited by examiner

*Primary Examiner*—Michael J. Zanelli

(57) ABSTRACT

A method and an apparatus for determining the clearance between the rotor blades of a rotor assembly and a shroud disposed radially outside of the rotor assembly is provided that calculates steady-state operating conditions for a given power engine setting and utilizes those steady-state conditions to determine a steady-state clearance at the given power setting. The method and apparatus further calculate instantaneous thermal conditions for the rotor disk, rotor blades, and shroud. The instantaneous thermal conditions are subsequently used to determine the amount of instantaneous thermal expansion of the rotor disk, rotor blades, and shroud. A clearance transient overshoot is determined using the calculated instantaneous thermal expansions. The actual clearance is determined using the steady-state clearance and the clearance transient overshoot.

18 Claims, 4 Drawing Sheets

METHOD AND APPARATUS FOR USE IN CONTROL OF CLEARANCES IN A GAS TURBINE ENGINE

This application is a continuation of U.S. patent application Ser. No. 09/220,546 filed Dec. 23, 1998, now abandoned.

The U.S. Government has rights relating to this invention pursuant to Air Force Contract F33657-91-C-0007.

BACKGROUND OF THE INVENTION

1. Technical Field

The present invention relates to rotor assemblies and liners within a gas turbine engine, and more particularly to radial clearance control between a rotor assembly and a liner disposed radially outside the rotor assembly.

2. Background Information

A gas turbine engine includes a fan section, a compressor section, a combustor section, and a turbine section disposed along a longitudinal axis. Air enters the engine through the fan section, passes through the compressor and into the combustor where fuel is mixed with the air and combusted. The combustion products, and any uncombusted air and/or fuel subsequently pass into the turbine and exit the engine through a nozzle. Collectively, the air and combustion products may be referred to as core gas, and the path through the fan, compressor, combustor, turbine, and nozzle referred to as the core gas path.

The fan, compressor and turbine sections include a plurality of rotor stages separated by stator sections. Each rotor stage includes a rotor assembly surrounded by a shroud. The rotor assembly includes a plurality of rotor blades attached to and circumferentially distributed around a disk. Radially outside of the rotor stage, the shroud defines the outer radial boundary of the gas path through that rotor stage. The outer radial surface of each rotor blade (i.e., the "blade tip") is positioned in close proximity to the inner radial surface of the shroud. The design clearance between the blade tips and the shroud is a predetermined value, chosen to minimize efficiency losses attributable to core gas passing between the blade tip and the shroud, while at the same time avoiding interference with the shroud. The actual clearance between the blade tips and the shroud will vary during operation of the engine.

What is needed is a method and an apparatus for controlling the actual clearance between a rotor stage and a shroud within a gas turbine engine, one that can predict instantaneous clearance values as a function of time, and one that can determine instantaneous clearance values under steady-state and transient conditions.

DISCLOSURE OF THE INVENTION

It is therefore, an object of the present invention to provide an apparatus and a method for predicting the actual clearance between a rotor stage and a shroud within a gas turbine engine, one that can predict instantaneous clearance values as a function of time, and one that can determine that instantaneous clearance values under transient conditions.

The actual clearance between a rotor assembly and shroud at any point in time is a function of: 1) the design dearance; 2) the current operating conditions of the engine; 3) the amount of wear within the shroud and rotor assembly; and 4) certain thermal and mechanical properties of the shroud and rotor assembly. The current operating conditions refers to the current status of the engine and the environment in which it is operating. An engine operating in a steady-state mode is one in which the operating environment and power settings have been stable long enough for the various components within the engine to have reached a substantially stable temperature. An engine operating in a transient mode is one in which the operating environment and power settings have recently changed and the various components within the engine have not yet reached a substantially stable temperature. The thermal and mechanical properties of the shroud and rotor assembly include, but are not limited to, the thermal time constants ($\tau$) and a coefficients of expansion associated with the rotor disk, the rotor blades, and the shroud. The thermal time constant ($\tau$) is a value that reflects the rate at which an element (e.g., the rotor disk, rotor blades, or shroud) changes temperature. The coefficient of expansion reflects the rate at which an element (e.g., the rotor disk, rotor blades, or shroud) changes physical size in response to a thermal change. The differences in the thermal time constant and the coefficient of expansion between the rotor disk, rotor blades, and the shroud are attributable to the elements being comprised of different materials and/or having different physical geometries.

Under steady-state conditions, the clearance between the rotor blades and the shroud is substantially constant because there is no appreciable thermal expansion (negative or positive) within the disk, blades, and/or shroud. Under transient conditions, the clearance between the rotor blades and the shroud fluctuates predominantly because of the different thermal properties of the components that create the clearance. An engine operating at a first power setting that is rapidly changed to a significantly different power setting will, for example, experience a rapid change in rotor speed and a rapid change in core gas temperature. The rapid change in temperature will cause reactions of different magnitude in the disk, blades and shroud because of their different thermal properties. For example, the amount of time it takes the disk to become steady-state at the new core gas temperature is likely to be substantially more that it take the shroud or blades to become steady-state because of the mass of the disk. As a result, if the engine is operating at a low power setting and the power setting is substantially increased, the shroud is likely to radially expand at a faster rate than the disk thereby increasing the clearance between the rotor blades and the shroud until the disk reaches a steady-state condition at the new core gas temperature. Conversely, if the engine is operating at a high power setting and the power setting is rapidly decreased, the shroud is likely to radially contract at a faster rate than the disk thereby decreasing the gap between the rotor blades and the shroud until the disk reaches a steady-state condition at the new core gas temperature.

The graph shown in FIG. 1 includes three curves indicative of engine parameters before, during and after a rapid transition from an idle power engine operating condition to a partial power engine operating condition. A first curve 122 represents the magnitude of the rotor speed (N2). A second curve 124 represents the magnitude of the instantaneous clearance between the rotor blades and the shroud. A third curve 126 represents the steady-state clearance between the rotor blades and the shroud. During the time interval T0, the engine is stable at an idle operating condition and the rotor assembly and the shroud are at thermal equilibrium. During this time, the instantaneous clearance is equal to the steady-state clearance. In a brief subsequent time period T1, the engine power setting is rapidly increased from the idle operating condition to the partial power engine operating condition. The change in power setting causes the rotational speed of the rotor assembly to increase (see curve 122) and a radial expansion of the rotor assembly. As a result, the instantaneous clearance and the steady-state clearance both decrease due to mechanical growth of the rotor assembly. The increase in the engine power setting also causes an increase in the core gas temperature, and consequent heat transfer to and thermal expansion of the rotor assembly and shroud. Note that the curve depicting the reference steady-state clearance shows an initial greater decrease in gap because it assumes that the components (disk, blades, shroud) have changed temperature instantaneously. The difference between the instantaneous clearance curve 124 and the reference steady-state clearance curve 126 is predominantly a function of the mismatch between the thermal time constants of the rotor assembly and the shroud and the consequent thermal expansion of the same. In the time period T2, the operating conditions of the engine (e.g., the power setting, altitude, etc.) remain constant, although the clearance is in a transient mode. After the power setting of the engine was changed rapidly from idle to partial power, the temperature of the core gas also changed rapidly, becoming steady-state within a very short period of time. The temperature of the rotor assembly and the temperature of the shroud eventually become steady-state at T3, at which point the instantaneous clearance again equals the steady-state clearance.

According to an aspect of the present invention, a method and an apparatus for determining the clearance between the rotor blades of a rotor assembly and a shroud disposed radially outside of the rotor assembly is provided that calculates steady-state operating conditions for a given power engine setting and utilizes those steady-state conditions to determine a steady-state clearance at the given power setting. The method and apparatus further calculate instantaneous thermal conditions for the rotor disk, rotor blades, and shroud. The instantaneous thermal conditions are subsequently used to determine the amount of instantaneous thermal expansion of the rotor disk, rotor blades, and shroud. A clearance transient overshoot is determined using the calculated instantaneous thermal expansions. The actual clearance is determined using the steady-state clearance and the clearance transient overshoot.

In one embodiment of the present invention, the clearance transient overshoot is determined using values ($GAIN_R$, $GAIN_B$, $GAIN_S$) representative of the coefficients of thermal expansion of the rotor disk, rotor blades, and shroud. In another embodiment of the present invention, the clearance transient overshoot is determined using transfer functions ($GROWTH_R$, $GROWTH_B$, $GROWTH_S$).

One advantage is that the thermal time constant values ($\tau_R$, $\tau_B$, $\tau_C$) can be tailored to the application at hand, and any application as a function of time. The thermal time constants that are used to determine the instantaneous thermal conditions ($T_R$, $T_B$, $T_S$) are based on empirically collected data, or analytically developed data, or some combination thereof. They can be adjusted based on analytically developed or empirically collected data to more closely model actual conditions within a gas turbine engine. The values ($GAIN_R$, $GAIN_B$, $GAIN_S$) representative of the coefficients of thermal expansion of the rotor disk, rotor blades, and shroud are also based on empirically collected data, or analytically developed data, or some combination thereof. They too can be adjusted based on analytically developed or empirically collected data to more closely model actual conditions within a gas turbine engine.

Another advantage of the present invention is that it can be used with any rotor stage within a gas turbine engine. The present invention provides an apparatus and method for accurately determining the actual clearance between a rotor assembly and a shroud. The accurate clearance data possible with the present invention can be used with a variety of control means to adjust and actual or anticipated clearance to a desirable clearance. One of the elements of the present invention that helps provide accurate results is the use of an on-board engine model module. On-board engine models are a known way to provide accurate data relating to steady-state operating conditions attributable to certain power settings. The present invention uses that data to determine the difference between the instantaneous and the steady-state and uses that difference to adjust the steady-state clearance to arrive at an instantaneous clearance actual or predicted.

These and other objects, features and advantages of the present invention will become more apparent in the light of the following detailed description, accompanying drawings, and claims.

DETAILED DESCRIPTION OF THE INVENTION

Figure 1:
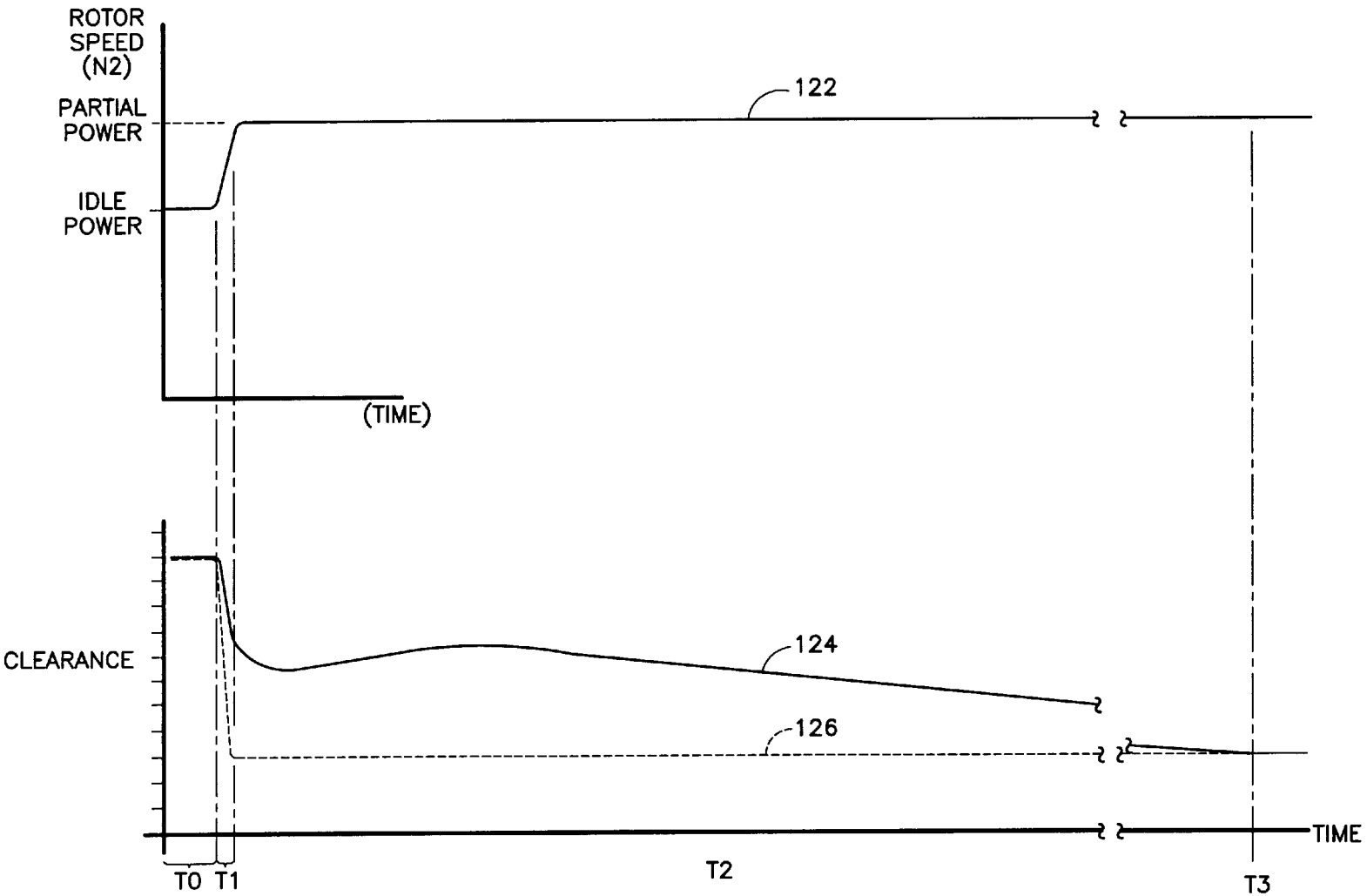
FIG. 1 is the graph illustrating the magnitudes of various engine parameters before, during, and after a rapid increase in the power setting of the engine.

The present invention provides for a method and an apparatus for determining the clearance between a rotor stage and a shroud within a gas turbine engine. The present method and apparatus include a Thermal Lag Module for modeling the thermal lag of a rotor assembly and a shroud within a gas turbine engine, an Engine Model Module for modeling the engine at a steady-state operating condition, a Steady-State Clearance Module for determining the steady-state clearance of the rotor assembly and shroud, and a Thermal Growth Module for modeling the thermal growth of the rotor assembly and shroud. The modules are a portion of an executable program disposed within the processor of an engine controller. As will be explained in greater detail below, the controller utilizes the clearance data provided by the present invention to control various devices within the engine to adjust the clearance, as necessary, during the operation of the engine.

The Thermal Lag Module produces signals ($T_R$, $T_B$, $T_S$) representative of the instantaneous thermal conditions of the rotor disk, rotor blades, and the shroud utilizing the following equations:

$$T_R = T_{prevR} + (T3 - T_{prevR})(1 - e^{-\Delta t/R\tau_R}) \quad \text{(Eq. 1)}$$

$$T_B = T_{prevB} + (T3 - T_{prevB})(1 - e^{-\Delta t/R\tau_B}) \quad \text{(Eq. 2)}$$

$$T_S = T_{prevS} + (T3 - T_{prevS})(1 - e^{-\Delta t/R\tau_S}) \quad \text{(Eq. 3)}$$

The signals are produced using input sensor data (T3, PB) and values representative of the thermal time constants of the disk, blades, and shroud ($\tau_R$, $\tau_B$, $\tau_S$). The T3 signal is produced by a temperature sensor that senses the core gas temperature in the region at the downstream end of the compressor. The PB signal is produced by a pressure sensor that senses the static pressure within the combustor. The thermal time constant values ($\tau_R$, $\tau_B$, $\tau_C$) are based on empirically collected data, or analytically developed data, or some combination thereof. These values can be adjusted, as necessary, to tune the thermal lag module to particular components and engine at hand. Because the heat transfer rates of the rotor disk, rotor blades, and shroud depend on the pressure in the combustor section and the pressure can vary significantly, a compensating factor can be used to adjust the thermal time constant values to account for variations in combustor pressure. For example, the Thermal Lag Module can be programmed to generate a thermal time constant scale factor signal, R, having a magnitude computed as a function of the PB signal and a signal, $PB_{ref}$, in accordance with equation (4):

$$R=(PB_{ref}/PB)^{0.5} \quad \text{(Eq. 4)}$$

The exponential value in Equation 4 need not be equal to 0.5, but rather is determined empirically and is typically in a range between 0.4 and 0.6. Note that if the engine operating condition remains constant, then the magnitudes of the $T_R$, $T_B$, and $T_S$ signals each eventually equal the magnitude of the T3 signal, thereby indicating that the rotor, the blades, and the shroud are at steady-state thermal conditions.

The Engine Model Module for modeling the engine provides signals representative of operating conditions for the engine given certain input signals. On-board engine models are well known. An example of an engine model is disclosed by R. H. Luppold et al., *Estimating In Flight Engine Performance Variations Using Kalman Filter Concepts*, 25$^{th}$ AIAA/ASME/SAE/ASEE Joint Propulsion Conference, Jul. 10–12, 1989, Monterrey Calif., Technical Paper No. AIAA-89-2584, incorporated by reference herein. The engine model module receives signals (T2, ALT, and MACH) representative of air temperature at an inlet of the gas turbine engine (T2), the altitude at which the gas turbine engine is operating (ALT), and representative of the mach number at which the engine is travelling (MACH). In response, the Engine Model Module generates signals P2, $\mathbf{P25}_{RATED}$, $PB_{RATED}$, $\mathbf{N2}_{RATED}$, $\mathbf{T25}_{RATD}$, and $\mathbf{T3}_{RATED}$. The P2 signal is indicative of a pressure at the inlet of the gas turbine engine. The five other signals are indicative of engine operating conditions at a predetermined steady-state engine power setting, specifically: the static pressure in the combustor section, a pressure at an upstream end of the compressor section, the rotational speed of the rotor assembly, a temperature of the core gas at the upstream end of the compressor section, and the temperature of the core gas at the downstream end of the compressor section. In the most preferred embodiment, the predetermined steady-state engine power setting is the full rated power setting. The $\mathbf{T3}_{RATED}$ signal, the $T_R$ signal, the $T_B$ signal, and the $T_S$ signal, are provided to the Thermal Growth Module.

The Thermal Growth Module uses the $\mathbf{T3}_{RATED}$ signal to represent thermal conditions of the rotor, the blades, and the shroud at steady state thermal conditions for the full rated power engine operating condition. The Thermal Growth Module contains values ($GAIN_R$, $GAIN_B$, and $GAIN_S$) that are representative of the coefficients of thermal expansion of the rotor disk, the rotor blades, and the rotor shroud. In particular, the $GAIN_R$, the $GAIN_B$, and the $GAIN_S$ values relate the thermal conditions represented by the $T_R$, the $T_B$, and the $T_S$ values to thermal expansions of the rotor disk, rotor blades, and shroud, respectively, and further relate the steady-state thermal conditions at the $\mathbf{T3}_{RATED}$ signal to the thermal expansions of the rotor disk, rotor blades, and the shroud.

The Thermal Growth Module generates a signal, CLEARANCE TRANSIENT OVERSHOOT (CTO), indicative of the difference between the instantaneous clearance that would occur in the event of a rapid transition to the full rated engine power setting and the steady-state clearance for the full rated engine power setting. The CTO signal has a magnitude computed in accordance with Equation 5.

$$CTO=GAIN_R(\mathbf{T3}_{RATED}-T_R)+GAIN_B(\mathbf{T3}_{RATED}-T_B)-GAIN_{SHROUD}(\mathbf{T3}_{RATED}-T_S) \quad \text{(Eq. 5)}$$

The term $GAIN_R$ ($\mathbf{T3}_{RATED}-T_R$) represents a difference between the thermal expansion of the rotor at steady-state for the full rated engine power setting and the thermal expansion of the rotor at the instantaneous thermal condition represented by the $T_R$ signal. The term $GAIN_B$ ($\mathbf{T3}_{RATED}-T_B$) represents a difference between the thermal expansion of the blades at steady-state for the full rated engine power setting and the thermal expansion of the blades at the instantaneous thermal condition represented by the TB signal. The term $GAIN_S$ ($\mathbf{T3}_{RATED}-T_S$) represents a difference between the thermal expansion of the shroud at steady-state for the full rated engine power setting and the thermal expansion of the shroud at the instantaneous thermal condition represented by the $T_S$ signal.

Figure 4:
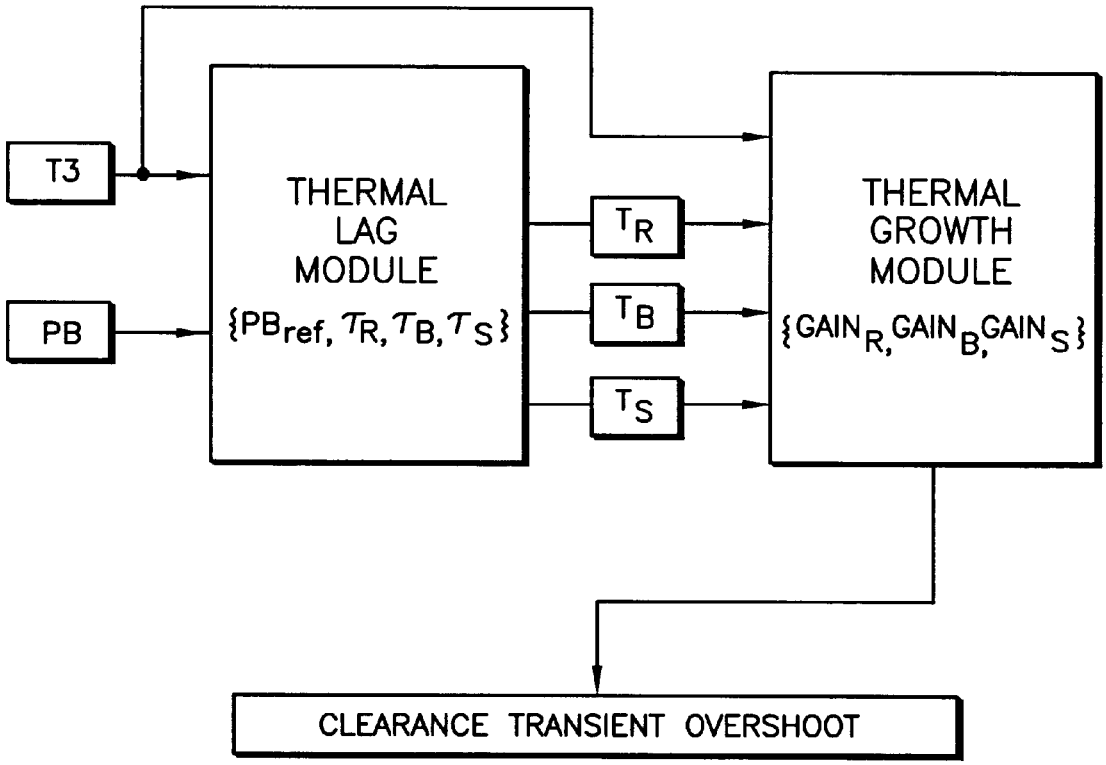
FIG. 4 is a functional block diagram illustrating an alternative embodiment of a Thermal Growth Module.

A preferred procedure for determining coefficient of expansion is as follows. Configure the Thermal Lag Module and the Thermal Growth Module as shown in FIG. 4. So configured, the CTO signal is indicative of a difference between an instantaneous clearance and a steady-state clearance for the present engine operating condition. Select an engine temperature (e.g., T3) to use as a representative core gas temperature for the determination of the coefficients of expansion. The representative core gas temperature is preferably the same engine temperature as that which is to be used to calculate the CTO signal. Use an analytical thermal model of the rotor assembly and the shroud to determine initial estimates of the thermal time constants and coefficients of expansion. Perform a plurality of tests representing a plurality of engine acceleration/deceleration operating scenarios. The scenarios should include various initial and final engine operating conditions under a variety of flight conditions, and should begin with the engine at thermal equilibrium. For each scenario, collect data on the reference engine temperature and the instantaneous clearance before, during, and after the scenario. The data will typically include 10 minutes of continuous transient data during thermal stabilization. A laser probe sensor or a capacitive sensor may be used to collect data on the instantaneous clearance. By analyzing the empirical data in view of the description hereinabove with respect to FIG. 1, it is possible to infer which components are doing what when. Calculate, plot and analyze CTO predictions. Compare the empirical data to the predictions. Based on the results of the comparison, adjust the thermal time constants and the thermal expansion coefficients used to generate the CTO signal so as to minimize deviations between the empirical clearance data and CTO signal. In the event that no one solution is optimum for all scenarios, it may be necessary to choose constants and coefficients that are best overall or best in the most critical scenarios. In the alternative, it may be desirable to incorporate features that select constants and coefficients in real time on the basis of the scenario. If the thermal expansion is a linear function of the change in the reference engine temperature, then a coefficient of expansion may be represented by a single value computed by dividing the expansion by the change in the reference engine temperature. If the expansion is not a linear function of the change in the reference engine temperature, then an average value may be used or alternatively, a transfer function relating the coefficient of expansion to the different thermal equilibrium temperatures for the reference engine temperature may be used. The transfer function may be in the form of an equation or alternatively, a look up table.

The T2 signal and the signals from the Engine Model Module are provided to a Steady-State Clearance Model Module, which determines a steady-state clearance for the full rated power engine operating conditions. Steady-state clearance models are well known. Such models for example determine the steady-state clearance by computing a steady-state closedown and summing thereto, a magnitude of a build clearance. One steady-state clearance model is disclosed in U.S. Pat. No. 5,165,844 to Khalid et al. incorporated by reference herein. Such model does not require all of the input signals described above but rather requires only the temperature at the inlet of the gas turbine engine (T2) and the rotational speed of the rotor assembly (N2). Another example of an acceptable steady-state clearance model is disclosed in Khalid et al., *Enhancing Dynamic Model Fidelity For Improved Prediction Of Turbofan Engine Transient Performance*, 16$^{th}$ AIAA/ASME/SAE Joint Propulsion Conference, Hartford Conn., Jun. 30–Jul. 2, 1980, Technical Paper No. AIAA-80-1083, incorporated by reference herein. The Steady-State Clearance Model Module produces a "Steady-State Clearance" signal representative of the steady-state clearance for the predetermined engine operating condition (which in the preferred case is full rated power). The signal from the Steady-State Clearance Model Module is subsequently passed through a compensation adder, which adjusts the signal, if necessary, to account for an increase in the clearance due to engine wear over time. The Steady-State Clearance signal is then provided to an adder 158, which adds the CTO signal thereto, to generate a CLEARANCER signal indicative of an instantaneous clearance that would result if the engine operating condition rapidly transitioned to the full rated power engine operating condition.

The CLEARANCE signal and/or the CTO signal provide the necessary input to the controller for a corrective action so that excessive and/or insufficient clearances can be avoided. Corrective actions include any one of, or some combination of: changing the power setting of the engine, changing the orientation of variable stator vanes, changing cooling flow, etc. These actions for altering the clearance between the rotor blade tips and the shroud are known and dependent on accurate clearance gap data, such as that produced by the present method and apparatus.

Figure 3:
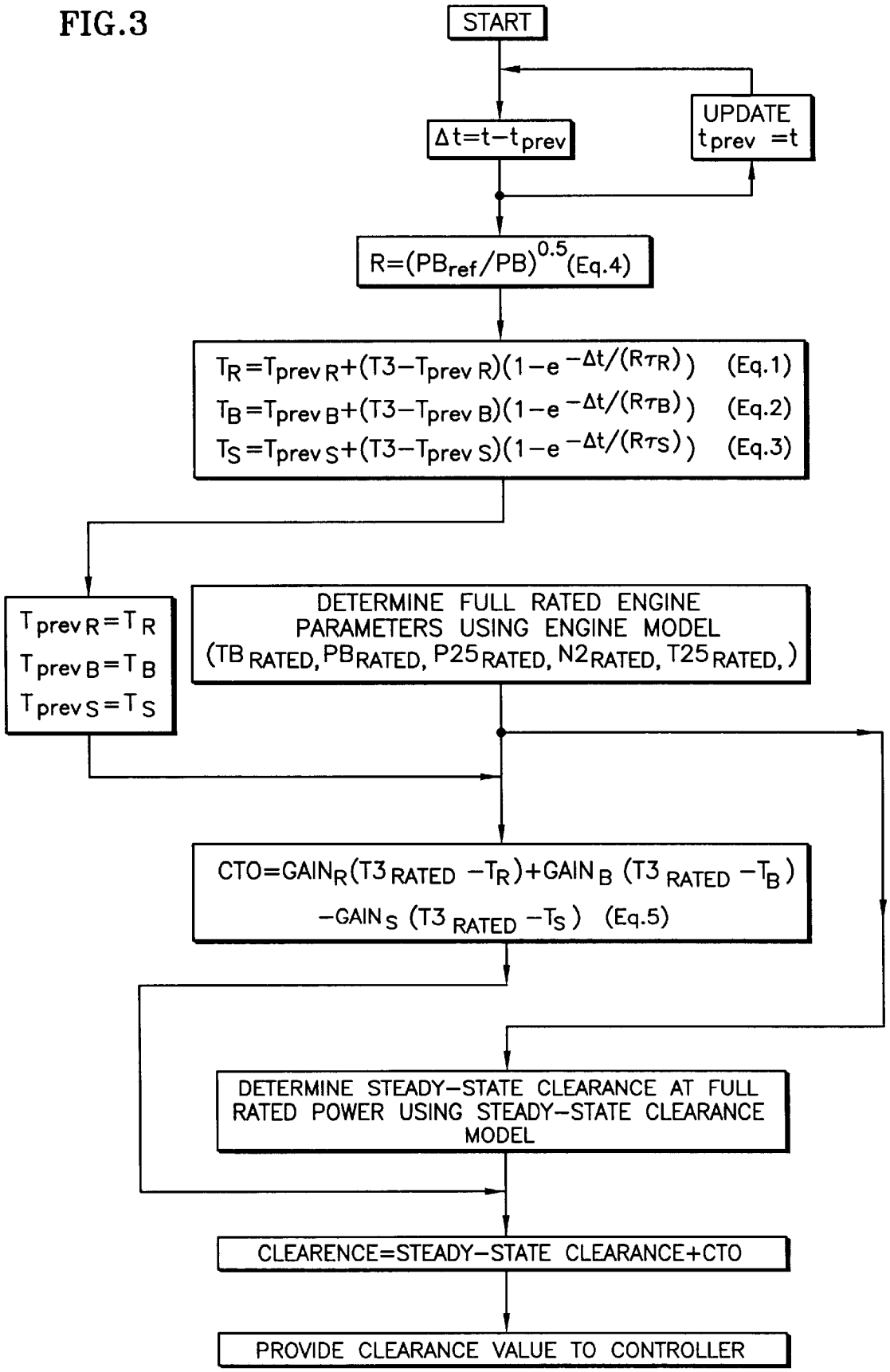
FIG. 3 is a flowchart of the steps in a portion of present invention method.

The flowchart shown in FIG. 3 illustrates the steps in a portion of the present method used to generate the CTO signal and the CLEARANCE signal. Generation of the CTO and the CLEARANCE signals is incrementally performed as a function of time, preferably at a substantially constant rate. The frequency rate at which the CTO and CLEARANCE values are computed can be any rate that provides the required accuracy and is possible given available computing time. In an initial step, the controller generates an incremental time signal At having a magnitude equal to the difference between the present time "t" and the previous time "$t_{prev}$". At step 204, the previous time $t_{prev}$ is iteratively updated to equal the magnitude of the present time t. At a step 206, the controller calculates the magnitude of the thermal time constant scaling factor signal R according Equation 4. At step 208, the Thermal Lag Module is used to generate the thermal condition signals $T_R$, $T_B$, and $T_S$ according to Equations 1, 2, and 3, wherein terms $T_{prevR}$/$T_{prevB}$, and $T_{prevS}$ refer to previous magnitudes of the $T_R$ signal, the $T_B$ signal, and the $T_S$ signal respectively. Equations 1–3 result in a first order lag. A first order lag is preferred in order to minimize complexity. However, different functions may be used to generate the $T_R$, the $T_B$, and the $T_S$ signals, including but not limited to functions that result in a lag of any order, a lead of any order, and combinations thereof. At step 210, the magnitudes of the signals $T_{preR}$, $T_{prevB}$, and $T_{prevS}$, are updated.

Figure 2:
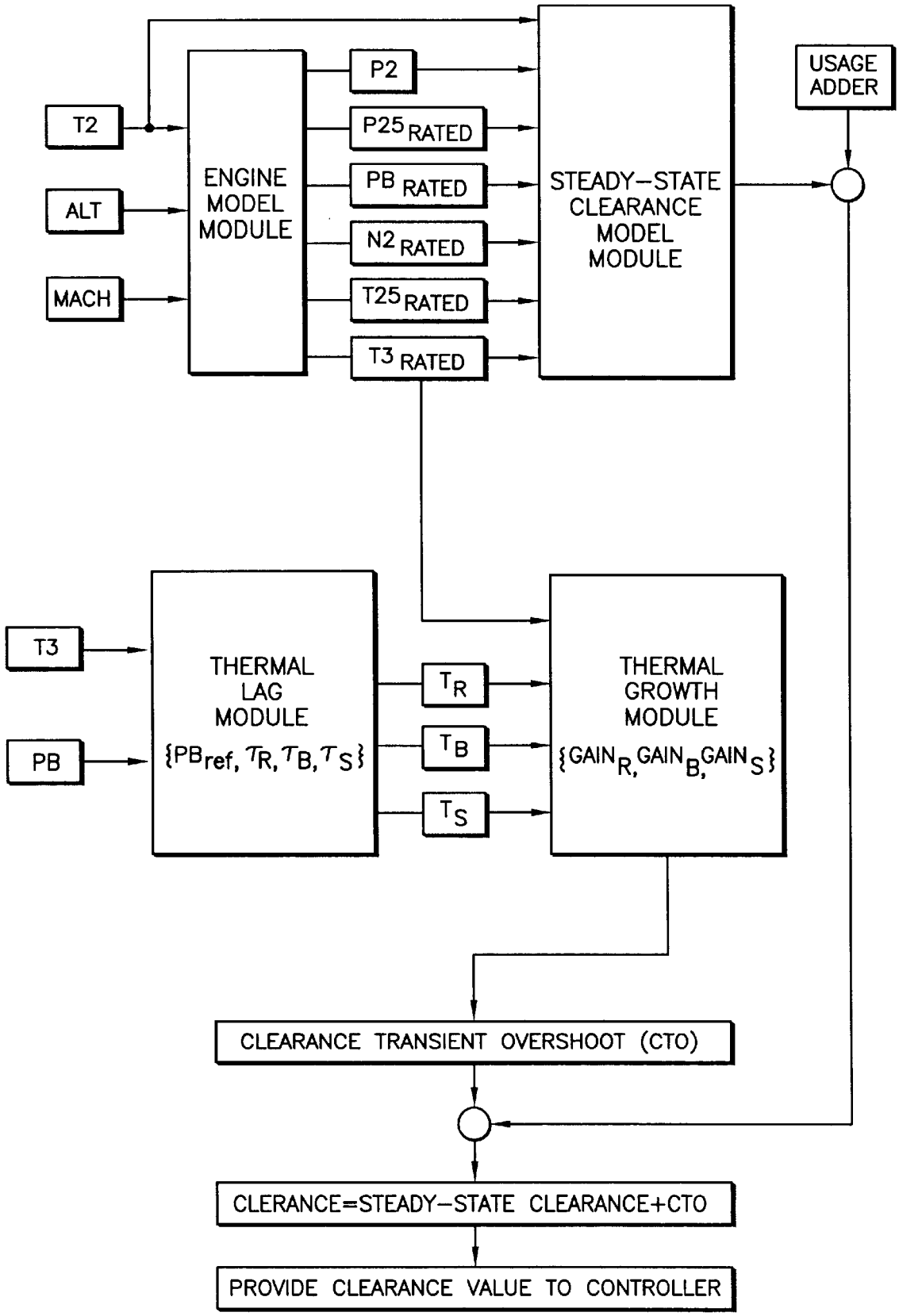
FIG. 2 is a functional block diagram showing the modules of the present invention control apparatus and method.

At a step 211, the full rated engine parameters are determined using the Engine Model Module described hereinabove and shown in FIG. 2. At a step 212, the processor generates the magnitude of the CTO signal in accordance with Equation 5. At a step 213, the processor determines the magnitude of the STEADY-STATE CLEARANCE signal using the Steady-State Clearance Model Module described hereinabove and shown in FIG. 2. At a step 214, the processor generates the magnitude of the CLEARANCE signal using the STEADY-STATE CLEARANCE AND THE CTO. At step 215, the CLEARANCE signal is provided to the controller for possible corrective action.

Referring now to FIG. 4, in an alternative embodiment, the Thermal Growth Module comprises signals representing three transfer functions: a $GROWTH_R$ transfer function, a $GROWTH_B$ transfer function, and a $GROWTH_S$ transfer function. The transfer functions represent coefficients of thermal expansion of the rotor disk, rotor blades, and shroud, respectively. In particular, the $GROWTH_R$ transfer function, the $GROWTH_B$ transfer function, and the $GROWTH_S$ transfer function relate the thermal conditions represented by the T3 and the $T_R$, $T_B$, and $T_S$ signals to thermal expansion of the rotor disk, rotor blades, and shroud, respectively.

The $GROWTH_R$ transfer function receives the T3 signal and the $T_R$ signal, and in response thereto, generates a signal, $GROWTH_R$(T3), indicative of the thermal expansion of the rotor for the thermal condition represented by the T3 signal, and generates a signal, $GROWTH_R(T_R)$ indicative of the thermal expansion of the rotor for the thermal condition represented by $T_R$ signal. The $GROWTH_B$ transfer function receives the T3 signal and the $T_B$ signal, and response thereto, generates a signal, $GROWTH_B$(T3), indicative of the thermal expansion of the blades for the thermal condition represented by the T3 signal, and generates a signal, $GROWTH_B(T_B)$ indicative of the thermal expansion of the blades for the thermal condition represented by $T_B$ signal. The $GROWTH_S$ transfer function receives the T3 signal and the $T_S$ signal, and response thereto, generates a signal, $GROWTH_S$(T3), indicative of the thermal expansion of the shroud for the thermal condition represented by the T3 signal, and generates a signal, $GROWTH_S(T_S)$ indicative of the thermal expansion of the shroud for the thermal condition represented by $T_S$ signal.

The Thermal Growth Module generates a CTO signal. The CTO signal is indicative of the difference between the instantaneous clearance that would occur in the event of a rapid transition to the full rated power engine operating condition and the steady-state clearance for the full rated power engine operating condition. The CTO signal has a magnitude generated in accordance with Equation 6.

$$CTO=(GROWTH_R(\mathbf{T3})-GROWTH_R(T_R))+(GROWTH_B(\mathbf{T3})-GROWTH_B(T_B))-(GROWTH_C(\mathbf{T3})-GROWTH_C(T_3)) \quad \text{(Eq. 6)}$$

The term $GROWTH_R(\mathbf{T3})-GROWTH_R(T_R)$ represents a difference between the thermal expansion of the rotor at steady-state for the full rated power engine operating condition and the thermal expansion of the rotor at the thermal condition represented by the $T_R$ signal. The term $GROWTH_B(T3)-GROWTH_B(T_B)$ represents a difference between the thermal expansion of the blades at steady-state for the full rated power engine operating condition and the thermal expansion of the blades at the thermal condition represented by the $T_B$ signal. The term $GROWTH_C(T3)-GROWTH_C(T_C)$ represents a difference between the thermal expansion of the shroud at steady-state for the full rated power engine operating condition and the thermal expansion of the shroud at the thermal condition represented by the $T_C$ signal.

In another embodiment, the transfer functions $GROWTH_R$, $GROWTH_B$, and $GROWTH_S$, may each receive a single input indicative of a thermal condition and in response generate an output indicative of difference between a thermal expansion at the thermal condition and a thermal expansion at a predetermined thermal condition. Transfer functions of this type may be appropriate where steady-state thermal conditions for an engine operating condition can be predetermined. The transfer functions, $GROWTH_R$, $GROWTH_B$, and $GROWTH_S$ may be of any type including a linear type, a nonlinear type, and combinations thereof. The transfer functions $GROWTH_R$, $GROWTH_B$, and $GROWTH_S$, are preferably reasonably accurate representations of the characteristics of thermal expansion of the rotor disk, the rotor blades, and the shroud including characteristics related to the structures and/or the materials of the rotor disk, the rotor blades, and the shroud. The transfer functions may be implemented as a lookup table, an equation, or any other suitable form.

Although this invention has been shown and described with respect to the detailed embodiments thereof, it will be understood by those skilled in the art that various changes in form and detail thereof may be made without departing from the spirit and the scope of the invention. For example, although the present invention is disclosed above as using full rated power engine operating conditions, the present invention is not limited to such. The present invention may be used to determine the clearance and/or the difference between the instantaneous clearance and the steady state clearance with respect to any engine operating conditions. As another example, those skilled in the art will recognize that although the processor in the disclosed embodiment comprises executable software, it may take other forms, including hardwired hardware configurations, hardware manufactured in integrated circuit form, firmware, and combinations thereof. As yet another example, although the detailed description of the invention above is disclosed as utilizing a signal indicative of a representative core gas temperature, any suitable signal indicative of the engine operating condition may be used. The signal may be a measured indication or a computed one. For example, a representative core gas temperature may be determined on the basis of other engine parameters, which themselves may be measured or computed. In addition, although disclosed with respect to an embodiment that does not compute the actual instantaneous temperatures and the actual steady state temperatures of the rotor assembly and the shroud, the present invention is not limited to such.

What is claimed is:

1. A method for determining the clearance between the rotor blades of a rotor assembly and a shroud disposed radially outside the rotor assembly within a gas turbine engine, wherein the rotor blades of the rotor assembly are attached to a rotor disk, said method comprising the steps of:

determine one or more steady-state operating conditions for a given steady-state power setting using a given temperature value, a given altitude value, and a given mach number value;

determine a steady-state clearance value for a predetermined power rating of the engine using said one or more steady-state operating conditions;

determine an instantaneous thermal condition ($T_R$) for the rotor disk, an instantaneous thermal condition ($T_B$) for the rotor blades, and an instantaneous thermal condition ($T_S$) for the shroud;

determine a value ($GAIN_R$) representative of the thermal expansion of the rotor disk, a value ($GAIN_B$) representative of the thermal expansion of the rotor blades, a value ($GAIN_S$) representative of the thermal expansion of the shroud, using said instantaneous thermal conditions;

determine an instantaneous clearance transient overshoot value (CTO) using said values representative of the thermal expansion of the rotor disk, rotor blades, and shroud;

determine a clearance value using said steady-state clearance value and said instantaneous clearance transient overshoot value.

2. The method of claim 1, wherein said instantaneous thermal conditions are determined using thermal lag coefficients ($\tau_R$, $\tau_B$, $\tau_S$) relating to each of the rotor disk, rotor blades, and shroud.

3. The method of claim 2, wherein said instantaneous thermal conditions are determined using a scale factor that adjusts for variations in pressure within said gas turbine engine.

4. The method of claim 3, wherein said scale factor is determined as a function of a sensed pressure value and a reference pressure value.

5. The method of claim 4, wherein said instantaneous thermal condition of the rotor disk $T_R$ is defined as: $T_R=T_{prevR}+(T3-T_{prevR})(1-e^{-\Delta t/(R\tau_R)})$.

6. The method of claim 4, wherein said instantaneous thermal condition of the rotor blades $T_B$ is defined as: $T_B=T_{prevB}+(T3-T_{prevB})(1-e^{-\Delta t/(R\tau_B)})$.

7. The method of claim 4, wherein said instantaneous thermal condition of the shroud $T_S$ is defined as: $T_S=T_{prevS}+(T3-T_{prevS})(1-e^{\Delta t/(R\tau_S)})$.

8. The method of claim 1, wherein said one or more steady-state operating conditions are calculated using an on-board engine modeling module.

9. The method of claim 1, wherein said instantaneous clearance transient overshoot value CTO is defined as: $CTO=GAIN_R(T3_{RATED}-T_R)+GAIN_BT3_{RATED}-T_B)-GAIN_{SHROUD}(T3_{RATED}-T_S)$.

10. The method of claim 1, wherein said steady-state power setting is the engine power setting that produces full rated engine operating conditions.

11. A method for determining the clearance between the rotor blades of a rotor assembly and a shroud disposed radially outside the rotor assembly within a gas turbine engine, wherein the rotor blades of the rotor assembly are attached to a rotor disk, said method comprising the steps of:

determine one or more steady-state operating conditions using a given temperature value, a given altitude value, and a given mach number value;

determine a steady-state clearance value for a predetermined power rating of the engine using said one or more steady-state operating conditions;

determine an instantaneous thermal condition ($T_R$) for the rotor disk, an instantaneous thermal condition ($T_B$) for the rotor blades, and an instantaneous thermal condition ($T_S$) for the shroud;

provide a transfer function ($GROWTH_R$) representative of the thermal expansion of the rotor disk, a transfer function ($GROWTH_B$) representative of the thermal expansion of the rotor blades, and a transfer function ($GROWTH_S$) representative of the thermal expansion of the shroud, using said instantaneous thermal conditions;

determine an instantaneous clearance transient overshoot value (CTO), using said transfer functions;

determine a clearance value using said steady-state clearance value and said instantaneous clearance transient overshoot value.

12. The method of claim 11, wherein said clearance transient overshoot value CTO is defined as: $CTO=(GROWTH_R(T3)-GROWTH_R(T_R))+(GROWTH_B(T3)-GROWTH_B(T_B))-(GROWTH_C(T3)-GROWTH_C(T_3)$.

13. An apparatus for determining the clearance between the rotor blades of a rotor assembly and a shroud disposed radially outside the rotor assembly within a gas turbine engine, wherein the rotor blades of the rotor assembly are attached to a rotor disk, said apparatus comprising:

a processing means for determining one or more steady-state operating conditions for a given steady-state power setting using a given temperature value, a given altitude value, and a given mach number value;

a processing means for determining a steady-state clearance value for a predetermined power rating of the engine using said one or more steady-state operating conditions;

a processing means for determining an instantaneous thermal condition ($T_R$) for the rotor disk, an instantaneous thermal condition ($T_B$) for the rotor blades, and an instantaneous thermal condition ($T_S$) for the shroud;

a processing means for determining a value ($GAIN_R$) representative of the thermal expansion of the rotor disk, a value ($GAIN_B$) representative of the thermal expansion of the rotor blades, a value ($GAIN_S$) representative of the thermal expansion of the shroud, using said instantaneous thermal conditions;

a processing means for determining an instantaneous clearance transient overshoot value (CTO) which utilizes said values representative of the thermal expansion of the rotor disk, rotor blades, and shroud;

a processing means for determining a clearance value using said steady-state clearance value and said instantaneous clearance transient overshoot value.

14. The apparatus of claim 13, wherein said instantaneous clearance transient overshoot value CTO is defined as: $CTO=GAIN_R(T3_{RATED}-T_R)+GAIN_B(T3_{RATED}-T_B)-GAIN_{SHROUD}(T3_{RATED}-T_S)$.

15. The apparatus of claim 13, wherein said steady-state power setting is the engine power setting that produces full rated engine operating conditions.

16. An apparatus for determining the clearance between the rotor blades of a rotor assembly and a shroud disposed radially outside the rotor assembly within a gas turbine engine, wherein the rotor blades of the rotor assembly are attached to a rotor disk, said apparatus comprising:

a processing means for determining one or more steady-state operating conditions for a given steady-state power setting using a given temperature value, a given altitude value, and a given mach number value;

a processing means for determining a steady-state clearance value for a predetermined power rating of the engine using said one or more steady-state operating conditions;

a processing means for determining an instantaneous thermal condition ($T_R$) for the rotor disk, an instantaneous thermal condition ($T_B$) for the rotor blades, and an instantaneous thermal condition ($T_S$) for the shroud;

a processing means that includes a transfer function ($GROWTH_R$) representative of the thermal expansion of the rotor disk, a transfer function ($GROWTH_B$) representative of the thermal expansion of the rotor blades, and a transfer function ($GROWTH_S$) representative of the thermal expansion of the shroud, using said instantaneous thermal conditions;

a processing means for determining an instantaneous clearance transient overshoot value (CTO) which utilizes said transfer functions;

a processing means for determining a clearance value using said steady-state clearance value and said instantaneous clearance transient overshoot value.

17. The apparatus of claim 16, wherein said clearance transient overshoot value CTO is defined as: $CTO=(GROWTH_R(T3)-GROWTH_R(T_R))+(GROWTH_B(T3)-GROWTH_B(T_B))-(GROWTH_C(T3)-GROWTH_C(T_3)$.

18. The apparatus of claim 16 wherein said steady-state power setting is the engine power setting that produces full rated engine operating conditions.

* * * * *